US005264314A

United States Patent [19]

Mahabadi et al.

[11] Patent Number: 5,264,314

[45] Date of Patent: Nov. 23, 1993

[54] PROCESSES FOR THE PREPARATION OF TONERS

[75] Inventors: Hadi K. Mahabadi, Toronto; Michael Cunningham, Georgetown; Heather Wright, Burlington; Sandra J. Gardner, Willowdale, all of Canada

[73] Assignee: Xerox Corporation, Stamford, Conn.

[21] Appl. No.: 858,451

[22] Filed: Mar. 27, 1992

[51] Int. Cl.[5] ..... G03G 9/09

[52] U.S. Cl. ..... 430/137

[58] Field of Search ..... 430/137

[56] References Cited

U.S. PATENT DOCUMENTS

| | | | |
|---|---|---|---|
| 4,077,804 | 3/1978 | Vanzo | 430/137 |
| 4,601,968 | 7/1986 | Hyosu | 430/137 |
| 4,626,489 | 12/1986 | Hyosu | 430/137 |
| 4,816,366 | 3/1989 | Hyosu et al. | 430/137 |
| 4,845,007 | 7/1989 | Hyosu et al. | 430/137 |
| 5,043,404 | 8/1991 | Mahabadi et al. | 526/194 |
| 5,164,282 | 11/1992 | Mahabadi | 430/137 X |

FOREIGN PATENT DOCUMENTS 41471 2/1991 Japan .

*Primary Examiner*—Roland Martin

*Attorney, Agent, or Firm*—E. O. Pagazzo

[57] ABSTRACT

A process for the preparation of toner compositions which comprises mixing at least one resin monomer with a polymerization initiator, a crosslinking component and a chain transfer component; effecting bulk polymerization until partial polymerization to near the onset of the gel-effect has been accomplished thereby forming an organic phase containing a partially polymerized component; mixing the aforementioned partially polymerized component organic phase with pigment or dye particles; dispersing the resulting organic phase in water containing a stabilizing component whereby there is obtained a suspension of toner particles in water; and polymerizing the toner suspension by heating.

27 Claims, No Drawings

PROCESSES FOR THE PREPARATION OF TONERS

BACKGROUND OF THE INVENTION

This invention is generally directed to processes for the preparation of toner compositions, and more specifically, to semisuspension polymerization processes for the preparation of black and colored, like cyan, yellow, magenta, and the like, toners. In one embodiment, the present invention is directed to semisuspension polymerization processes for the economical preparation of toners with, for example, an average volume diameter of from about 3 to about 25, and preferably from about 3 to about 7 microns, wherein a mixture of monomer or comonomers, a polymerization initiator, a crosslinking component and a chain transfer component are bulk polymerized until partial polymerization to the onset of the gel-effect is accomplished; followed by adding to the formed partially polymerized polymer pigments or dyes, optional additives such as charge control materials, low molecular weight waxes, such as polypropylene, or polyethylene, and the like to form an organic phase, and then mixing this organic phase with, for example, a high shear mixer to obtain a homogeneous organic mixture; subsequently dispersing the resulting organic mixture in water containing a stabilizing component, which dispersing can be accomplished, for example, by a high shear mixer; transferring the resulting suspension to a reactor; and effecting polymerization thereof; followed by cooling, optional washing, and drying. The toner composition obtained can be optionally blended with surface additives, which may function as flow aids, such as colloidal silicas and the like. The gel-effect is a known phenomenon in the polymerization process and the onset of the gel-effect can be indicated as a conversion after which both the rate of polymerization and molecular weight of polymer produced during polymerization increase rapidly. Conversion is determined gravimetrically. The degree of conversion at which the gel-effect commences is related to the volume of polymer, molecular weight of polymer and the specific monomer system. This conversion $x_b$ can be represented by $x_b = K_c d_p / dM_n^{0.5}$ where $K_c$ is an entanglement parameter characteristic of the particular system, $d_p$ is the density of the pure polymer produced during polymerization, d is the overall density of the monomer/polymer mixture and $M_n$ is the number average molecular weight of polymer produced during polymerization. Conversion at the onset of the gel-effect ($x_b$) for a given polymerization system can be calculated using this equation. In the absence of a gel-effect, the conversion, x, at any time, t, during the polymerization can be represented by $x = 1 - \exp(-kt)$ where x is the fractional conversion of monomer to polymer, t is the reaction time and k is a reaction rate constant. The onset of the gel-effect can also be determined as that time of reaction at which the actual conversion exceeds the conversion predicted by the equation $x = 1 - \exp(-kt)$ by a factor of 1.2, that is the actual conversion exceeds the conversion that would be obtained in the absence of gel-effect by 20 percent. In one embodiment, the process of the present invention comprises the bulk polymerization of comonomers, such as styrene methacrylates, like styrene-n-butylmethacrylate or styrene acrylates, like styrene butyl acrylate, and the like suitable for toner resins with an initiator/catalyst up to a conversion of the comonomers to polymer which is within from about 1 to about 5 percent of the conversion of the onset of the gel effect; terminating the aforementioned bulk polymerization by cooling the partially polymerized monomer or comonomers; adding pigments, and other optional additives, such as charge additives followed by mixing with, for example, a high shear mixer to form the organic phase; dispersing this organic phase into the aqueous phase comprised of an aqueous solution of a suspension stabilizer and optionally an aqueous phase inhibitor such as potassium iodide; forming a suspension with, for example, a high shear homogenizer with particles with an average volume particle diameter of from about 3 to about 7 microns; heating to initiate suspension polymerization, and retaining the mixture at a high temperature of from about 50 to about (about as used herein includes points in between the parameters recited) 120° C. and more preferably from between about 60 to about 80° C., thereby completing the conversion of comonomers to polymer, separating the polymer product by filtration after cooling; and subsequently washing to eliminate the stabilizer; followed by filtration, and drying, for example, by freeze drying, vacuum drying, spray drying or fluid bed drying whereby there results polymer particles with an average particle diameter of from about 3 to about 7 microns.

Advantages associated with the processes of the present invention in embodiments include improved pigment dispersion, substantial avoidance of coalescence, narrow particle size distribution, for example, from about 1.1 to 1.3, the preparation of small, for example in embodiments 3 to 7 microns diameter, black and color toners with high projection efficiency and high gloss, and toner particles with less residual surfactant on the surface and therefore better flow.

Toners have been prepared generally by fusion mixing of pigments (colorants), charge control agents and other additives into thermoplastic resins to disperse them uniformly therein. In view of the high viscosity of the mixture, a considerable amount of energy is needed to achieve uniform dispersion of pigments and other additives in the toner resin. The mixture is then cooled, followed by pulverization and classification into desired particle sizes and particle size distribution. It is known that pulverization is an energy intensive step in this process. This preparation method is capable of producing excellent toners, but requires the use of several steps which are costly, energy intensive and are limited in certain respects. In the process for producing toners by pulverization, the material most usually be fragile so as to be readily pulverized to a certain extent. Therefore, some thermoplastic resins which are not fragile but have good fusing performance are not usually selected for the aforementioned prior art processes. Also, if the material is too fragile, it may be excessively micropulverized and, therefore, the fines portion of the particles must be uneconomically removed. These limitations become increasingly severe for smaller particle size toners. Moreover, when a material with a low melting point is employed to improve fusing performance of the toner, fusion of such material may occur in the pulverizing device or the classifier.

Accordingly, in order to avoid or minimize the disadvantages of the pulverization method, there have been proposed processes for producing toner wherein the toner particles were formed and correct particle size distribution produced in a reactor. These processes include dispersion polymerization, suspension polymerization, emulsion polymerization, and the like. Disclosed in U.S. Pat. No. 4,486,559 is the preparation of a toner composition by the incorporation of a prepolymer into a monomer/pigment mixture, followed by emulsion polymerization, see for example columns 4, 5 and 8 of this patent. Also, methods of preparing toner, including suspension/dispersion polymerization, are detailed in columns 1 and 2 of this patent. In these processes, the pigment and additives such as charge control components are added to a monomer or comonomers prior to polymerization. Particle formation is achieved by the dispersion of the pigmented monomer or comonomers in a continuous phase, such as water, and the droplets of pigmented monomers are then polymerized to form toner particles. One advantage of these processes as compared to many other methods is the elimination of fusion mixing (Banbury/extruder) and pulverization classification processing. Nevertheless, it can be difficult with these processes to accomplish polymerization of pigmented monomer droplets in a diameter range of 3 to 25 microns with a narrow distribution of particle diameter of, for example, 1.3. Also, suspension failure is common with these processes especially when monomer droplet diameter is less than 50 microns and as polymerization proceeds in the sticky region (10 to 60 percent conversion). Further, it is difficult to conduct the polymerization of pigmented monomer droplets since, for example, it is known that polymerization of free radical type monomers are hindered, and many times prevented by the presence of various pigments, especially carbon black. Another disadvantage of some of the prior art processes for the preparation of toners resides in the resulting poor dispersion of the pigment and other additives within particles which is believed to be caused by the lack of mixing within individual particles during polymerization and incompatibility of pigment with polymer produced during polymerization which results in pigment aggregation. Moreover, some of the prior art processes for the preparation of particles can be costly, or not as economical as desired. These and other disadvantages are avoided or minimized with the semisuspension polymerized toner processes of the present invention.

Also mentioned are U.S. Pat. Nos. 4,486,559, which discloses the incorporation of a prepolymer into a monomer toner mix followed by emulsion polymerization; 4,680,200 and 4,702,988, which illustrate emulsion polymerization; and 4,797,339 and 4,996,127 which disclose a process in which small primary particles are produced by emulsion polymerization, and then these particles are imbedded with pigment on the surface and aggregated, thereby providing improved pigment dispersion, however, this process involves many steps, thereby rendering it costly and reducing yields. In addition, control of the molecular weight and molecular weight distribution is difficult because of the very low molecular weights required and the natural tendency of emulsion polymerizations to produce very high molecular weights. Furthermore, because the pigment is on the surface of the aggregated particle, charging behavior of the toner can vary when different pigments are used.

In patentability search reports, there were recited as background U.S. patents disclosing suspension polymerization U.S. Pat. Nos. 4,077,804; 4,601,968; 4,626,489; 4,816,366 and 4,845,007; 5,043,404 directed to semisuspension polymerization; and 3,954,898, which discloses bulk and suspension polymerization, see the Abstract for example.

In U.S. Pat. Nos. 5,164,282, the disclosure of which is totally incorporated herein by reference, there are illustrated processes for the preparation of toners, and more specifically, semisuspension polymerized toner processes in which a mixture of monomer or comonomers, a polymerization initiator, a crosslinking component and a chain transfer component is bulk polymerized until partial polymerization, that is for example from about 10 to about 40 percent of monomer or comonomers is converted to a polymer; thereafter mixing the partially polymerized product with pigments, optional charge control agents and other additives with, for example, a high shear homogenizer to form a uniform organic phase, dispersing the organic phase in water containing a stabilizing component with, for example, a high shear mixer to produce a narrow particle size toner suspension; and polymerizing the suspension product. The toner obtained can then be washed/dried and dry blended with surface flow aid additives. However, the processes described in U.S. Pat. No. 5,164,282 do not provide as good a dispersion as the process of the present invention since, for example, it does not accomplish, for example, the conversion at which the bulk polymerization must be terminated. In U.S. Pat. No. 5,164,282, it is indicated that the bulk polymerization should be conducted until partial conversion from 10 to 40 percent is achieved, and this will not usually provide uniform dispersion of pigment throughout the particle interior as individual pigment particles as determined by transmission electron microscopy, but rather will result in pigment particles migrating to the toner particle surface and/or aggregating in clusters of primary pigment particles. In order to achieve uniform dispersion of individual pigment particles throughout the particle interior and control of micromixing, it has been found that the partial polymerization should be conducted to within 1 to 5 percent of the onset of the gel-effect, which depends on the temperature and molecular weight of the polymer. Subsequently, when the suspension polymerization begins after the organic phase is dispersed in the aqueous phase, the polymerization rate, molecular weight and viscosity in the particle will increase rapidly, thereby restricting diffusion of pigment and other additives within the toner particles and ensuring good pigment dispersion. Pigment dispersion is influenced primarily by the initial polymer viscosity, which depends on the type of polymer, molecular weight of polymer, polymer concentration and temperature, versus time profile in the polymerizing particle and the size of the pigment particle. For a given pigment diameter, pigment diffusion can be minimized by increasing the initial viscosity of the organic phase and by reducing the time available for diffusion to occur, which is the time between when the dispersion is created and when the viscosity in the particles reaches a very high value, typically when the conversion is greater than 80 percent, and by maximizing the viscosity during that period initial viscosity of the organic phase can be increased using semisuspension polymerization by increasing polymer concentration and/or the molecular weight of the polymer produced during the polymerization or by reducing the temperature. Reducing the time available for diffusion to occur can be achieved by conducting the suspension polymerization in the gel-effect regime so that the rate of polymerization is very high, for example in the range of 0.05 to 1 moles/liter/-minute. Therefore, these objectives can be achieved by conducting the bulk polymerization to within 1 to 5 percent of the onset of the gel-effect. When the bulk polymerization is terminated before the onset of the gel-effect, the rate of viscosity increases and increasing the conversion in the polymerizing toner particles will be more gradual than when the bulk polymerization was terminated at the onset of the gel-effect since the subsequent rate of increase of polymer concentration will be less, and the viscosity is very sensitive to increases in conversion (polymer concentration). This lower rate of increase in viscosity will result in uncontrolled diffusion of pigment to the particle surface and to the formation of clusters of primary pigment particles and therefore overall poor pigment dispersion. If the bulk polymerization is conducted beyond the onset of the gel-effect, the reaction will be very difficult to control because of the rapid increase in the viscosity which results in a wide GSD of the particles. Therefore, by terminating the bulk polymerization within 1 to 5 percent of the onset of the gel-effect, micromixing is controlled and pigment dispersion is improved, yielding toner with high projection efficiency and high gloss in embodiments of the present invention.

SUMMARY OF THE INVENTION

It is, therefore, an object of this invention to provide processes for the preparation of toner compositions with many of the advantages illustrated herein.

In another object of the present invention there are provided simple and economical processes for the preparation of black and colored toners.

Another object of the present invention resides in simple and economical processes for the preparation of black and colored toners with small size particles and narrow particle size distribution with improved pigment dispersion, permitting high projection efficiency of 7 to 100 percent and high gloss, where a gloss level of less than 50 percent is considered low and a gloss level of greater than 50 percent is considered high.

Further, another object of the present invention resides in simple processes for the preparation of low cost, black and colored toners with an average volume particle size diameter as determined by Coulter Counter measurements of from about 3 to about 25, and preferably from about 3 to about 7 microns, and narrow particle size distribution, preferably from about 1.10 to about 1.35. The final particle size and particle size distribution is affected by several factors; the initial particle size distribution of the dispersion is affected by the organic phase viscosity, the aqueous phase viscosity, type of stabilizer, concentration of stabilizer, temperature, duration of shearing and type of dispersing equipment used. The particle size distribution of the final toner product is also affected by the above factors but it can be added to by coalescence during the suspension polymerization. Coalesence occurs when the conversion is low enough that particles are sticky and can adhere to each other; coalesence ceases when the viscosity becomes sufficiently high, typically when the conversion exceeds about 80 percent. Smaller particles are more prone to coalesence and particle size distribution broadening than larger particles, and therefore, for small particles it is particularly important to minimize coalesence in order to minimize broadening of the particle size distribution. By partially polymerizing the monomers to within about 1 to 5 percent of the onset of the gel-effect, the time available for particle coalesence is significantly reduced and therefore particle size distribution broadening is minimized.

Additionally, in another object of the present invention there are provided simple and economical processes for black and colored toner particles with an average particle size diameter of 3 to 7 microns, a narrow particle size distribution, a high degree of pigment and other additives dispersion, that is for example the particles are dispersed as primary particles and not aggregates and wherein these particles are uniformly dispersed throughout the particle and are not all located at the particle surface as measured by transmission electron microscopy, and a higher degree of flexibility in controlling molecular weight and molecular weight distribution of the toner resin without the use of pulverization/classification can be accomplished. The combination of these factors can also provide higher projection efficiency of transmitted light as measured by the fraction of incident light that is transmitted through a sample of the toner.

These and other objects of the present invention can be accomplished by the provision of processes for the preparation of toners, and more specifically, to semisuspension polymerized toner processes in which a mixture of monomer or comonomers, a polymerization initiator, a crosslinking agent and a chain transfer component is bulk polymerized until to within about 1 to about 5 percent of the onset of the gel-effect; thereafter mixing the partially polymerized product with pigments, optional charge control agents and other additives with, for example, a high shear homogenizer to form a uniform organic phase; dispersing the organic phase into water containing a stabilizing component with, for example, a high shear mixer to produce a narrow particle size toner suspension and wherein the particles suspended possess, for example, an average volume particle diameter of from about 3 to about 7 microns; polymerizing the suspension product by heating, and thereafter cooling. The toner obtained can then be washed/dried and dry blended with surface flow aid additives to produce small size toner of from about 3 to about 7 microns with narrow particle size distribution of from about 1.1 to about 1.35 and with uniform distribution of primary pigment/additive particles, and not clusters of primary particles in the interior of the toner particle, and not concentrated primarily at the toner particle surface.

More specifically, the process of the present invention is comprised of (1) mixing a monomer or comonomers with polymerization initiators, a crosslinking component and a chain transfer component; (2) effecting bulk polymerization by increasing the temperature of the mixture to from about 50° C. to about 120° C., and more preferably from 60° to 80° C., until the degree of conversion is within 1 to about 5 percent of the onset of the gel-effect where the degree of conversion at which the gel-effect commences is related to the volume of polymer, molecular weight of polymer and the specific monomer/polymer system such that the conversion at the onset of the gel-effect $x_b$ is given by $x_b = K_c d_p / d M_n^{0.5}$ where $K_c$ is an entanglement parameter characteristic of the particular system, $d_p$ is the density of the pure polymer produced during polymerization, d is the overall density of the monomer/polymer mixture and $M_n$ is the number average molecular weight of polymer produced during the polymerization; (3) mixing with the aforesaid partially polymerized monomer product pigments, charge control agents and other additive using a high shear mixer to formulate a uniform organic phase; (4) dispersing the organic phase into from 2 to about 5 times its volume of water containing from about 1 to about 5 weight percent of a stabilizing component to form a toner suspension with an average particle size of from about 5 to about 25 microns and a particle size distribution of from about 1.1 to about 1.3 using a high shear mixer; (5) transferring the resulting toner suspension to a reactor and polymerizing by increasing the process temperature to from about 55° to about 120° C. to complete the conversion of monomer, or comonomers to polymer product; (6) washing the product with water and/or an alcohol alkyl, 1 to about 20 carbon atoms, such as methanol; (7) separating polymer particles by, for example, filtration or centrifugation; (8) drying the toner particles obtained; and (9) optionally dry blending with flow additives such as colloidal silica, and/or charge control additives.

Also, the process of the present invention is directed to the preparation of black and colored toner particles with an average volume particle diameter of from about 5 microns to about 25 microns, and preferably about 3 to about 7 microns and with resin binders synthesized to have any desirable average molecular weight, for example a number average molecular weight of from about 5,000 to about 500,000, a weight average molecular weight of from about 10,000 to about 2,000,000, and desired molecular weight distribution, for example a molecular weight distribution with from about 1 to about 4 peaks. Further, the process of the present invention is directed to the preparation of black and colored toner particles of an average diameter of from about 5 microns to about 25 microns, a particle size distribution of from 1.1 to about 1.3 with the resin binder having a number average molecular weight in the range of 5,000 to about 100,000, and a weight average molecular weight of 25,000 to about 400,000; and a molecular weight distribution having 1 to 3 peaks.

In one embodiment of the present invention, there is provided a process for the preparation of toner particles which comprises mixing at least one resin monomer with a polymerization initiator, a crosslinking component and a chain transfer component; effecting bulk polymerization until partial polymerization to within about 1 to about 5 percent of the onset of the gel-effect is accomplished, where the degree of conversion at which the gel-effect commences is related to the volume of polymer, molecular weight of polymer and the specific monomer/polymer system such that the conversion at the onset of the gel-effect $x_b$ is given by $x_b = K_c d_p / d M_n^{0.5}$ where $K_c$ is an entanglement parameter characteristic of the particular system, $d_p$ is the density of the pure polymer produced during polymerization, d is the overall density of the monomer/polymer mixture and $M_n$ is the number average molecular weight of polymer produced during polymerization; mixing with the aforementioned partially polymerized monomer product pigment or dye particles and charge enhancing component until a uniform organic phase is formed; dispersing the organic phase in water containing a stabilizing component whereby there is obtained a suspension of toner particles in water; and polymerizing the toner suspension. Another embodiment of the present invention is directed to a process for the preparation of toner particles which comprises mixing resin monomer, comonomers, or mixtures thereof with a polymerization initiator, a crosslinking component and a chain transfer component; effecting bulk polymerization to within 1 to about 5 percent of the onset of the gel-effect where the degree of conversion at which the gel-effect commences is related to the volume of polymer, molecular weight of polymer and the specific monomer/polymer system such that the conversion at the onset of the gel-effect $x_b$ is given by $x_b = K_c d_p / d M_n^{0.5}$ where $K_c$ is an entanglement parameter characteristic of the particular system, $d_p$ is the density of the pure polymer produced during polymerization, d is the overall density of the monomer/polymer mixture and $M_n$ is the number average molecular weight of polymer produced during polymerization; mixing with the partially polymerized monomer product pigments or dyes and charge control materials until a uniform organic phase is formed; dispersing the organic phase in water containing a stabilizing component thereby obtaining a suspension of toner particles in water; polymerizing the toner suspension wherein there is formed a toner product; and subsequently washing and drying the toner particles.

The process of the present invention in another embodiment comprises (1) mixing a monomer or comonomers with polymerization initiator with the ratio of monomer or comonomers to initiator being from about 100/2 to about 100/20, a crosslinking component with the ratio of monomer or comonomers to catalyst component being from about 100/0.01 to about 100/5 and a chain transfer component with the ratio of monomer or comonomers to the chain transfer component being from about 100/0.01 to about 100/1; (2) effecting bulk polymerization by increasing the temperature of the mixture to from about 50° C. to about 120° C. to a conversion of within 1 to 5 percent of the onset of the gel-effect, as defined by the aforementioned equation, to produce a polymer or polymers having a number average molecular weight of from 5,000 to about 50,000 and a weight average molecular weight of from about 10,000 to about 200,000; (3) mixing with the partially polymerized monomer product from about 5 to about 70 weight percent pigment and one to 5 weight percent charge control agent and other additives using a high shear mixer to form a uniform organic phase; (4) dispersing the uniform organic phase to from about 2 to about 5 times its volume water containing from about 1 to about 5 weight percent stabilizing component, preferably polyvinyl alcohol or hydroxypropyl cellulose with a weight average molecular weight of from 1,000 to about 10,000 to form a toner suspension with a particle size of from about 5 to about 25 microns with particle size distribution of from about 1.1 to about 1.3 by using a high shear mixer; (5) transferring the resulting toner suspension to a reactor and polymerizing the suspension by increasing the temperature to from about 55° C. to about 120° C. to allow the complete conversion of monomer or comonomers to polymer; (6) washing the product with equal volume of methanol and/or water for 3 to 5 times; (7) separating toner particles from water/methanol by means of filtration or centrifugation; (8) drying of the toner particles; and (9) dry blending of toner with required additives such as flow agent, and the like.

Illustrative examples of monomer or comonomers selected for the processes of the present invention and present in effective amounts as illustrated herein, for example, include vinyl monomers of styrene and its derivatives such as styrene, α-methylstyrene, p-chlorostyrene and the like; monocarboxylic acids and their derivatives such as acrylic acid, methyl acrylate, ethyl acrylate, butyl acrylate, dodecyl acrylate, octyl acrylate, phenyl acrylate, methacrylic acids, methyl methacrylate, ethyl methacrylate, butyl methacrylate, octyl methacrylate, acrylonitrile and acrylamide; dicarboxylic acids having a double bond and their derivatives such as maleic acid, monobutyl maleate, dibutymaleate; vinyl esters such as vinyl chloride, vinyl acetate and vinyl benzoate; vinyl ketones such as vinyl methyl ketone and vinyl ether ketone; and vinyl ethyl ether and vinyl isobutyl ether; vinyl naphthalene; unsaturated mono-olefins such as isobutylene and the like; vinylidene halides such as vinylidene chloride and the like; N-vinyl compounds such as N-vinyl pyrrole and the like; and mixtures thereof. Generally styrene acrylates, styrene methacrylates, styrene butadienes, and the like can be selected for the processes of the present invention.

Examples of initiator present in effective amounts of from about 0.1 weight percent to about 10 weight percent and more preferably from about 1 percent to 5 percent as illustrated herein, selected for the process of the present invention, include azo and diazo compounds such as azoisobutyronitrile, azodimethylvaleronitrile, azobiscyclohexanitrile, 2-methylbutyronitrile, diazoamine-azobenzene, mixtures thereof, and the like and peroxide compounds such as dibenzoyl peroxide, di-(n-propyl) peroxydicarbonate, t-butyl benzoate, t-amyl (2-ethylhexyl) monoperoxydicarbonate, 2,2-di-(t-butylperoxy) butane, dicumyl peroxide, t-butyl peroxide, and mixtures thereof. The bulk polymerization temperature can be selected, for example, according to the initiator used. Generally, the molecular weight of polymer decreases as the amount of initiator or polymerization temperature increases. For example, the molecular weight would decrease to from about 5,000 to about 25,000 as the initiator concentration was increased from about 1.5 percent to about 6 percent. The bulk polymerization temperature, initiator types and concentration should be selected to obtain monomer polymerized to within 1 to 5 percent of the onset of the gel-effect and to enable polymer with a weight average molecular weight in the range of 10,000 to about 200,000. This polymer will assist in the dispersion of pigment and also can coat the pigment particle and, therefore, minimize the inhibition effects of pigment on the suspension polymerization as well as further improving pigment dispersion by reducing pigment aggregation.

The polymer in embodiments should preferably be crosslinked to some extent to provide improved toner and/or image anti-offset characteristics. Examples of crosslinkers selected for the process of the present invention include compounds having two or more polymerizable double bonds. Specific examples of such compounds include aromatic divinyl compounds such as divinylbenzene and divinylnaphthalene; carboxylic acid esters with two double bounds, such as aliphatic glycols like ethylene glycol diacrylate, ethylene glycol; dimethylacrylate and the like; divinyl compounds such as divinyl ether, divinyl sulfide, divinyl sulfone and the like. The crosslinking component should preferably be present in an amount of from about 0.1 to about 5 parts by weight in 100 parts by weight of monomer or comonomers mixture.

Stabilizer present in effective amount of from about 0.01 percent to about 5 percent and more preferably from about 0.1 percent to about 2 percent as illustrated herein, for example, and selected for the process of the present invention includes nonionic and ionic water soluble polymeric stabilizers such as methyl cellulose, ethyl cellulose, hydroxypropyl cellulose, block copolymer, such as PLURONIC E87 TM available from BASF, the sodium salts of carboxyl methyl cellulose, polyacrylate acids and their salts, polyvinyl alcohol, gelatins, starches, gums, alginates, zein, casein and the like; and barrier stabilizers such as tricalcium phosphate, talc, barium sulfate and the like.

The chain transfer component selected functions to control molecular weight by inhibiting chain growth. Typical of chain transfer agents utilized for the process of the present invention are mercaptans, such as laurylmercaptan, butylmercaptan and the like, or halogenated carbons such as carbon tetrachloride or carbon tetrabromide and the like. The chain transfer agent should preferably be present in an amount of from about 0.01 to about 1 weight percent of monomer or comonomers mixture.

Numerous well known suitable pigments can be selected as the colorant for the toner particles including, for example, carbon black, like Cl Pigment Black 7, REGAL 330® carbon black, nigrosine dye, aniline blue, phthalocyanine derivatives, magnetites and mixtures thereof. The pigment should be present in a sufficient amount to render the toner composition colored thereby permitting the formation of a clearly visible image. Generally, the pigment particles are present in amounts of from about 3 percent by weight to about 20 percent by weight, based on the total weight of the toner composition, however, lesser or greater amounts of pigment particles can be selected.

When the pigment particles are comprised of magnetites or iron oxides, including those commercially available as Cl Pigment Black 11, they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments are magnetites as they enable, for example, images with no toner spots for extended time periods exceeding the development of 100,000 images, which corresponds to about 400,000 imaging cycles for a panel containing four imaging members.

Also embraced within the scope of the present invention in embodiments are colored toner compositions containing as pigments or colorants red, blue, green, brown, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as Cl 60710, Cl Dispersed Red 15, a diazo dye identified in the Color Index as Cl 26050, Cl Solvent Red 10, Cl Pigment Red 48, Cl Pigment Red 122, and the like. Illustrative examples of cyan materials that may be used as pigments include copper tetra-4 (octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Cl Pigment Blue 19, Cl Solvent Blue 79, and the like; while illustrative examples of yellow pigments that may be selected include diarylide yellow 3,3-dichlorobenzidene acetoacetanilides, a monazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Cl Pigment Yellow 31, and the like. These pigments are generally present in the toner composition in effective amounts, such as for example in an amount of from about 2 weight percent to about 15 weight percent, based on the weight of the toner resin particles.

Illustrative examples of optional charge enhancing additives present in various effective amounts, such as, for example, from about 0.1 to about 20 percent by weight, and preferably from about 1 to about 3 weight percent include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonnium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like.

With further respect to the toner and developer compositions of the present invention, another optional component present includes the linear polymeric alcohol comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and can be added as uniformly dispersed internal, or as finely divided uniformly dispersed external additives. More specifically, the polymeric alcohols are present in an amount of from about 0.5 percent by weight to about 20 percent by weight, while as external additives the polymeric alcohols are present in an amount of from about 0.05 percent by weight to slightly less than about 5 percent by weight.

The stabilizer on the surface of the toner particles can, if desired, be substantially removed by washing with an aliphatic alcohol containing from 1 to about 25 carbon atoms including, for example, methanol, propanol, ethanol, butanol, and the like, or water. Separation of washed toner particles from solution can be achieved by selecting any known classical separation technique such as filtration, centrifugation and the like. Classical drying technique such as vacuum drying, freeze drying, spray drying, fluid bed drying and the like can be selected for drying the toner.

The following Examples are being submitted to further define various species of the present invention. These Examples are intended to be illustrative only and are not intended to limit the scope of the present invention. Also, parts and percentages are by weight unless otherwise indicated.

EXAMPLE I

To 90 grams of styrene were added 60 grams of butyl methacrylate and 7 grams of 2,2'azo-bis(2,4-dimethylvaleronitrile), which components were mixed until dissolved. This mixture was then bulk polymerized by heating in a one liter glass reactor to 60° C. by means of an oil bath while the mixture was stirred with a TEFLON ® propeller until 38 percent of the comonomers were converted to polymer, as determined gravimetry, with a number average molecular weight of 18,000 and a weight average molecular weight of 31,000 as measured by gel permeation chromatography. Under these conditions the onset of the gel-effect occurs at a conversion of 39 percent, therefore the bulk conversion was within 1 percent of the onset conversion. To the resulting comonomer/polymer mix were then added 6 grams of Pigment Red 48 pigment and 6 grams of cetyl pyridinium chloride followed by mixing with a Brinkmann PT456G high shear homogenizer with 10,000 revolutions per minute for 2 minutes to form a uniform organic phase. The uniform organic phase was then poured together with 500 milliliters of water containing 0.75 weight percent of hydroxypropyl cellulose into a two liter stainless steel beaker. The beaker was placed in an ice bath and using a Brinkmann PT456G polytron homogenizer the mixture was then vigorously stirred at 10,000 revolutions per minute for 4 minutes to provide a microsuspension of toner particles in water. The suspension was then transferred to a 1 liter glass reactor equipped with a TEFLON ® propeller with a stirring speed of 300 revolutions per minute and the contents of the reactor were heated to 60° C. and controlled at that temperature by means of an oil bath. After four hours, the suspension polymerization was complete, and the resulting toner product was poured into two liters of hot, 50° C., water. The resulting diluted suspension was then stirred for 15 minutes. The supernatant liquid comprised of the diluted hydroxypropyl cellulose was decanted, fresh water was added and the mixture was stirred for 15 minutes to disperse the particles. This washing procedure was repeated four times with deionized water. After the final wash, the slurry was poured into a tray and freeze dried to yield clean, dry individual toner particles of 93 percent of the copolymer of styrene/n-butyl methacrylate, 3.5 percent of the pigment Pigment Red 48 and 3.5 percent of cetyl pyridinium chloride. Using a Coulter Counter particle sizer, analysis of the dry toner product was conducted and evidenced an average volume particle size of 6 microns. As measured by gel permeation chromatography, the number average molecular weight of the styrene butyl methacrylate toner resin was 23,000 and the weight average molecular weight was 67,000. The formed toner product was mixed with 0.3 weight percent of the colloidal silica (R972) to provide a toner with excellent flow characteristics, as determined by the very low (less than 3 percent) fraction of toner retained on a series of vibrating screens of different mesh sizes. Using a transmission electron microscope, photomicrographs of the dry toner product were taken and evidenced excellent pigment dispersion within the particles, that is the pigment particles were uniformly spread throughout the particles and were not aggregated in the particle interior or at the surface. Projection efficiency, as calculated by the ratio of the intensity of specular and diffuse light transmitted through a fused toner image to the intensity of the total light projected at the image, was 81 percent. Excellent pigment dispersion is advantageous as projection efficiency as measured by the fraction of incident light transmitted through an image is greater when the pigment is more uniformly dispersed than when the pigment is aggregated within the particle or at the particle surface. Higher projection efficiency results in superior color quality. Consequently, less pigment is required and the cost can be reduced.

Evaluation of the blocking tendency of the above prepared toner was conducted after permitting 20 grams of the toner to remain in a thermostat oven set at 55° C. for 24 hours, followed by allowing to cool to room temperature. No blocking, that is toner agglomeration, was observed for the above prepared toner.

Print quality evidenced an excellent level of fix as measured by the crease test method, showing a crease area of less than 65 square micrometers.

EXAMPLE II

The process of Example I was repeated except that the organic phase was dispersed in water containing 1.0 weight percent of hydroxypropyl cellulose. The onset of the gel-effect was again 39 percent, and the bulk conversion was conducted to a conversion of 38 percent. The resulting toner had an average particle diameter size of 4 microns. other characteristics of the prepared toner were substantially equivalent to that of the toner of Example I.

EXAMPLE III

The process of Example I was repeated except that the organic phase was dispersed in water containing 0.50 weight percent of hydroxypropyl cellulose. The onset of the gel-effect was again 39 percent, and the bulk conversion was conducted to a conversion of 38 percent. The resulting toner had an average particle size diameter of 9 microns. The other characteristics of the prepared toner were substantially equivalent to the toner of Example I.

EXAMPLE IV

To 90 grams of styrene were added 60 grams of butyl methacrylate and 7 grams of 2,2′ azobis(2,4-dimethylvaleronitrile) which were mixed until dissolved. This mixture was bulk polymerized by heating in a one liter glass reactor to 50° C. by means of an oil bath while the mixture was stirred with a TEFLON® propeller until 34 weight percent of the comonomers was converted to polymer (determined gravimetrically) with a number average molecular weight of 29,000 and a weight average molecular weight of 55,000 as measured by gel permeation chromatography. The onset of the gel-effect was determined to occur at a conversion of 33 percent. Therefore, the difference between the bulk conversion and the onset of the gel-effect was 1 percent. To the resulting comonomers/polymer mixture were then added 6 grams of Heliogen Blue pigment, 0.6 gram of divinylbenzene crosslinking agent and one gram of the linear polymeric alcohol UNILIN®, available from Petrolite Corporation, with a number average molecular weight of 600, followed by mixing with a Brinkmann PT456G high shear homogenizer with 10,000 revolutions per minute for about 3 minutes. The resulting uniform organic phase was then poured together with 500 milliliters of water containing 0.75 weight percent of hydroxypropyl cellulose into a two liter stainless steel beaker. The beaker was placed in an ice bath and using a Brinkmann PT456G polytron homogenizer the mixture was then vigorously stirred at 10,000 revolutions per minute for 4 minutes to form a microsuspension of toner particles in water. The resulting suspension of toner was then transferred to a 1 liter Parr reactor equipped with a magnetic stirrer, an aluminum block heater and cold water cooling. The suspension polymerization temperature was raised to 55° C. and held there for 2 hours, then the temperature is increased to 80° C. in 2 hours and held there for one hour, when it was then cooled to 25° C., and the toner product was poured into two liters of hot water. The resulting diluted suspension was stirred for 15 minutes. The supernatant liquid of the diluted hydroxypropyl cellulose was decanted, fresh water was added and the resulting mixture was stirred for 15 minutes. This washing procedure was repeated four times. After the final wash, the slurry was poured into a tray and vacuum dried to yield clean, dry individual toner particles. Using a Coulter Counter particle sizer, analysis of the dry toner product was conducted and evidenced an average particle size diameter of 7.5 microns. As measured by gel permeation chromatography, the number average molecular weight of the styrene-n-butyl methacrylate toner resin was 36,000, the weight average molecular weight was 101,000 and the molecular weight distribution evidenced two peaks. The toner product was mixed with 0.3 weight percent of the colloidal silica (R972) to provide a toner with excellent flowability. Using a transmission electron microscope, photomicrographs of the dry toner product were taken and evidenced excellent pigment dispersion within the particles, that is the pigment particles were uniformly spread throughout the particles and not aggregated in the particle interior or at the surface. Projection efficiency of the image formed by this toner was 83 percent.

Evaluation of the blocking tendency of this toner was accomplished by repeating the procedure of Example I, and the results indicated no blocking.

Print quality evidenced an excellent level of fix as measured by the crease test method, showing a crease area of less than 65 square micrometers.

EXAMPLE V

The process of Example IV was repeated except that 500 milliliters of water containing 1 weight percent of polyvinyl alcohol with molecular weight of 3,000 was used. The onset of the gel-effect was at 33 percent and the bulk polymerization was conducted to 35 percent. The resulting toner had an average (volume diameter in all instances) particle size of 3 microns. This toner was evaluated by repeating the procedure of Example IV and similar results were obtained.

EXAMPLE VI

The process of Example IV was repeated except that 500 milliliters of water containing 0.4 weight percent of PLURONIC F87 TM (BASF) stabilizer was used. The onset of the gel-effect was at 33 percent and the bulk polymerization was conducted to 34 percent. The resulting product had an average volume particle size diameter of 8 microns. This toner was evaluated by repeating the procedure of Example IV and similar results were obtained.

COMPARATIVE EXAMPLE

In order to illustrate the effect of varying the bulk conversion on pigment dispersion and projection efficiency, two additional experiments were conducted and are described below. For both, the onset of the gel-effect occurred at a conversion of 39 percent.

The process of Example I was repeated except that the comonomer mixture was bulk polymerized until 10 percent of the monomer was converted to polymer. Therefore, the difference between the onset conversion and the bulk conversion was 29 percent. The resulting toner had an average particle size diameter of 4 microns. Photomicrographs from a transmission electron microscope showed the pigment was aggregated at the edge of the particle. The projection efficiency was 52 percent compared to 81 percent for Example I.

The process of Example I was repeated except that the comonomer mixture was bulk polymerized until 30 percent of the monomers was converted to polymer. Therefore, the difference between the onset conversion and the bulk conversion was 9 percent. The resulting toner had an average particle diameter size of 5 microns. Photomicrographs from a transmission electron microscope showed the pigment was aggregated at the edge of the particle. The projection efficiency was 65 percent compared to 81 percent for Example I. A summary of the results for Example I and this comparative Example is provided in Table 1 and demonstrates that improved pigment dispersion results with the processes of the present invention when the initial conversion is closer to the onset of the gel-effect.

TABLE 1

| $X_b$ (%) | $\Delta X_{GE}$ (%) | PE (%) | Pigment Dispersion |
|---|---|---|---|
| 10 | 29 | 52 | Poor |
| 30 | 9 | 65 | Fair |
| 38 | 1 | 81 | Excellent |

$X_b$ represents the percentage of bulk conversion; $\Delta X_{GE}$ represents the conversion at onset of gel-effect 39 percent minus $X_b$; PE represents the projection efficiency; and the Pigment Dispersion is evaluated by Transmission Electron Microscopy.

Other modifications of the present invention may occur to those skilled in the art subsequent to a review of the present application. The aforementioned modifications, including equivalents thereof, are intended to be included within the scope of the present invention.

What is claimed is:

1. A process for the preparation of toner compositions consisting essentially of mixing at least one resin monomer with a polymerization initiator, a crosslinking component and a chain transfer component; effecting bulk polymerization until partial polymerization to within from 1 to 5 percent of the onset of the gel-effect has been accomplished thereby forming an organic phase containing a partially polymerized component; mixing the aforementioned partially polymerized component organic phase with pigment or dye particles; dispersing the resulting organic phase in water containing a stabilizing component whereby there is obtained a suspension of toner particles in water; and polymerizing the toner suspension by heating.

2. A process for the preparation of color and black toner particles with excellent pigment dispersion and which toner provides images with high gloss and excellent projection efficiency which process comprises mixing at least one resin monomer with a polymerization initiator, a crosslinking component and a chain transfer component; effecting bulk polymerization until partial polymerization to near the onset of the gel-effect has been accomplished thereby forming an organic phase, where the degree of conversion at which the gel-effect commences is related to the volume of polymer, molecular weight of the polymer and the specific monomer/polymer system wherein the conversion at the onset of the gel-effect $x_b$ is represented by $x_b = K_c d_p / d M_n^{0.5}$ where $K_c$ is an entanglement parameter characteristic, $d_p$ is the density of the polymer produced during polymerization, d is the overall density of the monomer/polymer mixture and $M_n$ is the number average molecular weight of the polymer formed during the bulk polymerization, mixing with the aforementioned partially polymerized product pigment or dye particles; dispersing the resulting organic phase containing said partially polymerized product in water containing a stabilizing component whereby there is obtained a suspension of toner particles in water; polymerizing the toner suspension by heating and thereafter cooling enabling toner particle with an average particle diameter of from about 3 to about 25 microns and with a narrow particle size distribution of about 1.1 to about 1.3; and wherein said bulk polymerization is accomplished up to conversion of the comonomers to polymer within from about 1 to about 5 percent of the conversion of the onset of said gel effect.

3. A process for the preparation of color and black toner particles which comprises the bulk polymerization of comonomers with an initiator/catalyst, a crosslinking component and a chain transfer component up to a conversion of the comonomers within 1 to 5 percent of the onset of the gel-effect where the onset of the gel-effect is defined by $x_b = K_c d_p / d M_n^{0.5}$ wherein $x_b$ is the onset conversion for the gel-effect, Kc is a constant characteristic of the monomer system, $d_p$ is the density of the polymer, d is the overall density of the mixture and $M_n$ is the number average molecular weight of the polymer generated during the bulk polymerization; terminating the bulk polymerization by cooling the partially polymerized monomer; adding colored pigments other than black, and optional additives to form the organic phase, followed by mixing with a high shear mixer; dispersing the organic phase into an aqueous phase containing an aqueous solution of stabilizer and optionally an aqueous phase inhibitor with a high shear homogenizer to enable a suspension with particles with an average particle diameter of from about 3 to about 7 microns; heating to initiate suspension polymerization, and retaining the mixture at a high temperature of from about 50° to about 120° C. thereby completing the conversion of comonomers to polymer; separating the polymer product by filtration after cooling; and subsequently washing to eliminate the stabilizer; followed by filtration and drying whereby there results toner particles with an average particle diameter of from about 3 to about 10 microns and a narrow particle distribution of about 1.1 to about 1.3.

4. A process in accordance with claim 2 wherein from 1 to about 10 monomers are selected.

5. A process in accordance with claim 2 wherein the dried toner particles are blended with flow aid additives, and have incorporated therein charge enhancing additives.

6. A process in accordance with claim 2 wherein the suspension of toner particles in water is formed in a container and then transferred to a reactor.

7. A process in accordance with claim 2 wherein the resulting toner particles are of an average diameter of from about 3 to about 7 microns.

8. A process in accordance with claim 2 wherein the pigment particles are cyan, magenta, yellow, red, blue, green, brown black, or mixtures thereof.

9. A process in accordance with claim 2 wherein bulk and suspension polymerization is accomplished by heating to a temperature of from about 50° to about 120° C., the number and weight average molecular weight of the polymer prepared in the bulk polymerization step is from about 5,000 to about 50,000 and from about 10,000 to about 300,000, respectively, and the molecular weight distribution of the toner polymer resin in the toner particles has one peak, or a plurality of peaks.

10. A process in accordance with claim 2 wherein the dispersion of the organic phase in the water containing stabilizing component is accomplished with a high shear homogenizer.

11. A process in accordance with claim 2 wherein the particle size and particle size distribution of the resulting toner is controlled by the mixing time, stabilizing concentration, and the viscosity of the organic phase during dispersion of the organic phase in the water containing stabilizing component, and wherein the monomers are selected from vinyl monomers.

12. A process in accordance with claim 2 wherein the monomers are styrene; monocarboxylic acids and the derivatives thereof; dicarboxylic acids with a double bond and the derivatives thereof; vinyl esters; vinyl ketones; vinyl naphthalene; unsaturated mono-olefins; vinylidene halides; and mixtures thereof.

13. A process in accordance with claim 2 wherein the monomers are styrene, α-methylstyrene, p-chlorostyrene, acrylic acid, methyl acrylate, ethyl acrylate, butyl acrylate, dodecyl acrylate, octyl acrylate, phenyl acrylate, methacrylic acids, methyl methacrylate, ethyl methacrylate, butyl methacrylate, octyl methacrylate, acrylonitrile or acrylamide; maleic acid, monobutyl maleate, or dibutylmaleate; vinyl chloride, vinyl acetate or vinyl benzoate; vinyl methyl ketone and vinyl ether ketone; and vinyl ethyl ether or vinyl isobutyl ether; isobutylene; vinylidene chloride; N-vinyl pyrrole; or mixtures thereof.

14. A process in accordance with claim 2 wherein the polymerization initiator is selected from the group consisting of azo, diazo, peroxide compounds, and mixtures thereof.

15. A process in accordance with claim 14 wherein the polymerization initiator is azoisobutyronitrile, azodimethylvaleronitrile, azobiscyclohexanitrile, 2-methylbutyronitrile, diazoamine-azobenzene, dibenzoyl peroxide, di-(n-propyl) peroxydicarbonate, t-butyl benzoate, t-amyl-(2-ethylhexyl) monoperoxydicarbonate, 2,2-di-(t-butylperoxy) butane, dicumyl peroxide, t-butyl peroxide or mixtures thereof.

16. A process in accordance with claim 2 wherein the crosslinking component is selected from the group consisting of ethylene glycol diacrylate, ethylene glycol dimethylacrylate, divinyl ether, divinyl sulfite, divinyl sulfone, divinylbenzene, and divinylnaphthalene.

17. A process in accordance with claim 2 wherein the chain transfer component is selected from the group consisting of mercaptans and halogenated hydrocarbons.

18. A process in accordance with claim 3 wherein the chain transfer agent is carbon tetrachloride, butylmercaptan, or laurylmercaptan.

19. A process in accordance with claim 3 wherein the stabilizing component is selected from the group consisting of nonionic and ionic water soluble polymeric stabilizers, polyvinyl alcohol, gelatins, starches, gums, alginates, zein and casein.

20. A process in accordance with claim 3 wherein the stabilizing component is selected from the group consisting of methyl cellulose, ethyl cellulose, hydroxypropyl cellulose, block copolymers, tricalcium phosphate, talc and barium sulfate.

21. A process in accordance with claim 2 wherein the pigment is carbon black, magnetites, nigrosine dye, Cl Solvent Blue 3 2,9-dimethyl-substituted quinacridone, an anthraquinone dye, a diazo dye, Cl Solvent Red 10, Cl Pigment Red 48, or Cl Pigment Red 122.

22. A process in accordance with claim 2 wherein there is further included as a component a charge enhancing additive selected from the group consisting of alkyl pyridinium halide, a quaternary ammonium sulfate or a quaternary ammonium sulfonate.

23. A process in accordance with claim 3 wherein there is further included as a component a charge additive of stearyl phenethyl dimethyl ammonium tosylate, distearyl dimethyl ammonium methyl sulfate, stearyl dimethyl hydrogen ammonium tosylate cetyl pyridinium chlorides, or cetyl pyridinium tetrafluoroborates; and wherein the resulting toner is blended with surface additives.

24. A process in accordance with claim 3 wherein the polymer is methyl methacrylate wherein $K_c$ ranges from 1.68 to 0.68 as the temperature increases from 45° C. to 90° C., $d_p$ ranges from 1.19 to 1.16 over the temperature range of from about 45° C. to 90° C., ranges from about 0.88 to about 1.19 and $M_n$ ranges from about 100,000 to about 150,000.

25. A process in accordance with claim 1 wherein the said bulk polymerization is continued to within one percent of the onset of said gel effect.

26. A process in accordance with claim 2 wherein the said bulk polymerization is continued to within one percent of the onset of said gel effect.

27. A process is accordance with claim 3 wherein the said bulk polymerization is continued to within one percent of the onset of said gel effect.

* * * * *